United States Patent [19]

Butcher

[11] Patent Number: 4,504,980

[45] Date of Patent: Mar. 19, 1985

[54] SECURITY HAND BAND

[76] Inventor: Dayton M. Butcher, 220 Cochran Rd., Lexington, Ky. 40502

[21] Appl. No.: 533,438

[22] Filed: Sep. 19, 1983

[51] Int. Cl.[3] ..... A41D 19/00; A45F 5/02

[52] U.S. Cl. ..... 2/160; 2/161 A; 2/DIG. 6; 24/442; 224/218; 224/901

[58] Field of Search ..... 224/218, 901, 219; 2/160, 161 A, 163, DIG. 6; 273/166; 128/165, 157; 24/442

[56] References Cited

U.S. PATENT DOCUMENTS

| | | | |
|---|---|---|---|
| 552,171 | 12/1895 | Farnham | 224/218 X |
| 1,294,938 | 2/1919 | Mullen | 224/218 X |
| 1,482,647 | 2/1924 | Gise | 224/219 X |
| 1,681,389 | 8/1928 | Blake | 2/161 A |
| 2,294,997 | 9/1942 | Merrion | 2/160 |
| 2,369,210 | 2/1945 | Capossela | 128/165 X |
| 3,288,136 | 11/1966 | Lund | 24/442 X |
| 3,321,068 | 5/1967 | Beach | 24/442 X |
| 3,503,546 | 3/1970 | Hunt | 224/218 |
| 4,069,954 | 1/1978 | Rauch | 224/219 |
| 4,374,439 | 2/1983 | Norman | 2/161 A |

*Primary Examiner*—Allan N. Shoap
*Attorney, Agent, or Firm*—Frank C. Leach, Jr.

[57] ABSTRACT

A security hand band is formed of a strip of bright colored, waterproof cloth. The strip has a first opening adjacent one end thereof to receive a user's thumb. After the user inserts the thumb in the first opening, the strip is passed around the back of the hand and then wrapped around the palm of the hand so that a second opening in the strip also receives the thumb of the user. The strip has attaching elements on its end beyond the second opening for cooperation with attaching elements on the portion of the strip passed over the back of the hand initially so as to retain the strip on the hand. The two openings are large enough to enable various size hands to use the security hand band. The portion of the strip in the palm of the hand of the user has a Velcro material to attach a canister of tear gas, for example, thereto through the canister having Velcro material for attaching to the Velcro material on the strip. The strip also has reflectors on its end beyond the second opening to reflect light at night.

12 Claims, 4 Drawing Figures

SECURITY HAND BAND

This invention relates to a security hand band and, more particularly, to a security hand band formed of a flexible material for retaining a protective device or the like in the hand of a user.

When a person is walking, jogging, running, or riding a bicycle, for example, the person may be attacked by another person or an animal. As a result, it has previously been suggested to use a protective device such as a personal protection tear gas cannister, for example, to prevent or ward off such an attack. The person usually carries such a cannister in a pocket, in a purse, or on a belt, for example. The user is required to retrieve the cannister from any of these locations, and this very short time interval of retrieval is the critical time span during which an attack can take place so that the cannister is not usually available when needed.

While a person could carry a cannister in the hand to avoid the short time interval of retrieval, this would require the person to continuously grip the cannister. This is not preferred by most persons. For an elderly person in particular, the gripping with sufficient force to continuously hold a protective device in the hand might not be possible. Furthermore, when running, it is not desired to have the hand tightly closed so as to grip because this tends to produce tension.

The security hand band of the persent invention satisfactorily overcomes the foregoing problems of avoiding the time for retrieval of the protective device while still having the protective device available without the hand having to continuously grip the protective device. The security hand band of the present invention accomplishes this through providing a strip of flexible or pliable material for wrapping around the hand of the user with the strip having retaining means for retaining a protective device or the like such as a personal protection tear gas cannister, for example, on the strip. Thus, the security hand band of the present invention retains a cannister in position for use without any time for retrieval and without requiring any gripping of the protective device except when it is to be used. This readily observed position of the protective device by a potential attacker probably would deter the potential attacker.

In addition to having the protective device readily available for use, the strip of the security hand band of the present invention has the protective device supported thereon so that the hand of the user is still free to perform other simple actions between the thumb and fingers as if the strip of the security hand band was not being worn with the protective device retained thereon. For example, the user can open doors, use keys, and pick up objects while wearing the security hand band of the present invention with the protective device supported thereon.

The strip of the security hand band of the present invention is formed so that it may fit any size hand of a user. Therefore, only one size strip of cloth as the security hand band needs to be used.

Various types of hand bands for supporting various articles or devices on the hand of a person have been previously suggested. Examples of these are found in U.S. Pat. Nos. 1,199,635 to Urmston, 1,294,938 to Mullen, 1,766,478 to Baker et al, and 4,148,424 to Fortenberry. None of these patents suggests supporting a protective device in a position in which it may be readily used by a user without any time period for retrieval.

An object of this invention is to provide a unique security hand band.

Another object of this invention is to provide a security hand band having particular utility for walkers, joggers, runners, and elderly persons.

Other objects of this invention will be readily perceived from the following description, claims, and drawings.

This invention relates to a security hand band including a strip of flexible material for wrapping around a hand of a user with the strip of flexible material having a first opening adjacent one end thereof to initially receive a thumb of the user. The strip of flexible material has retaining means on its outer side intermediate its ends to retain a protective device or the like adjacent the palm of the hand of the user with the retaining means being disposed on the strip of material for positioning in the palm of the hand of the user after the first opening has received the thumb of the user and the strip of flexible material has a portion passed around the back of the hand of the user prior to the strip of flexible material being passed over the palm of the hand of the user. The strip of flexible material has a second opening to receive the thumb of the user after the strip of flexible material has passed over the palm of the hand of the user with the strip of flexible material having the second opening disposed closer to its other end than to its one end. The strip of flexible material has attaching means to attach its portion beyond the second opening to the portion of the strip of flexible material passed around the back of the hand of the user prior to the strip of flexible material being passed over the palm of the hand of the user.

The attached drawings illustrate a preferred embodiment of the invention, in which.

Figure 1:
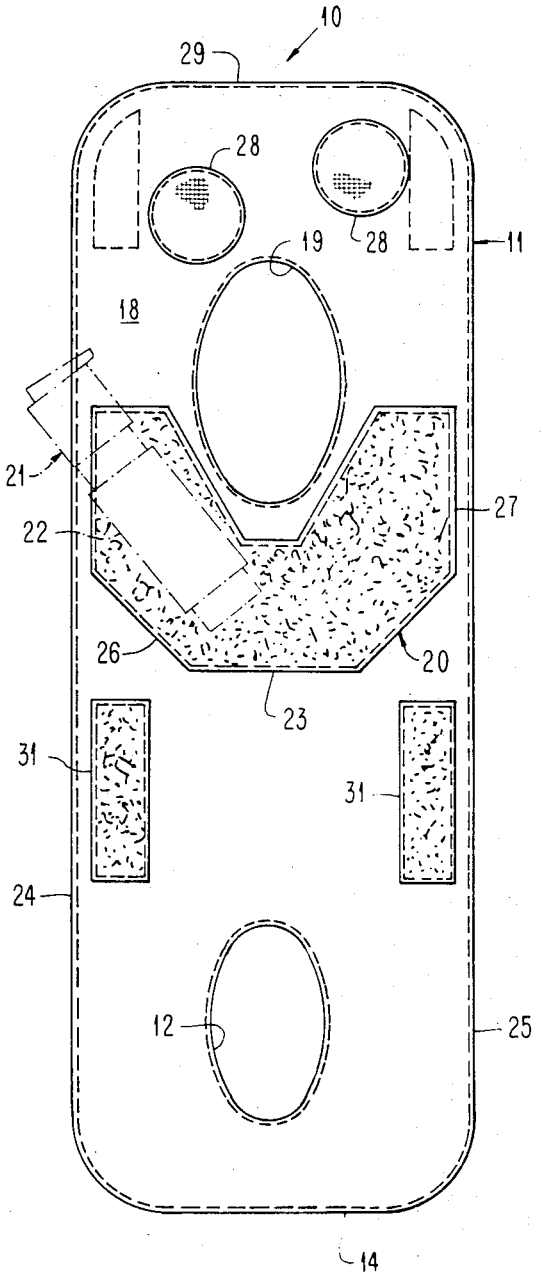
FIG. 1 is a plan view of the outer side of a security hand band of the present invention with a protective device shown in phantom.
Figure 2:
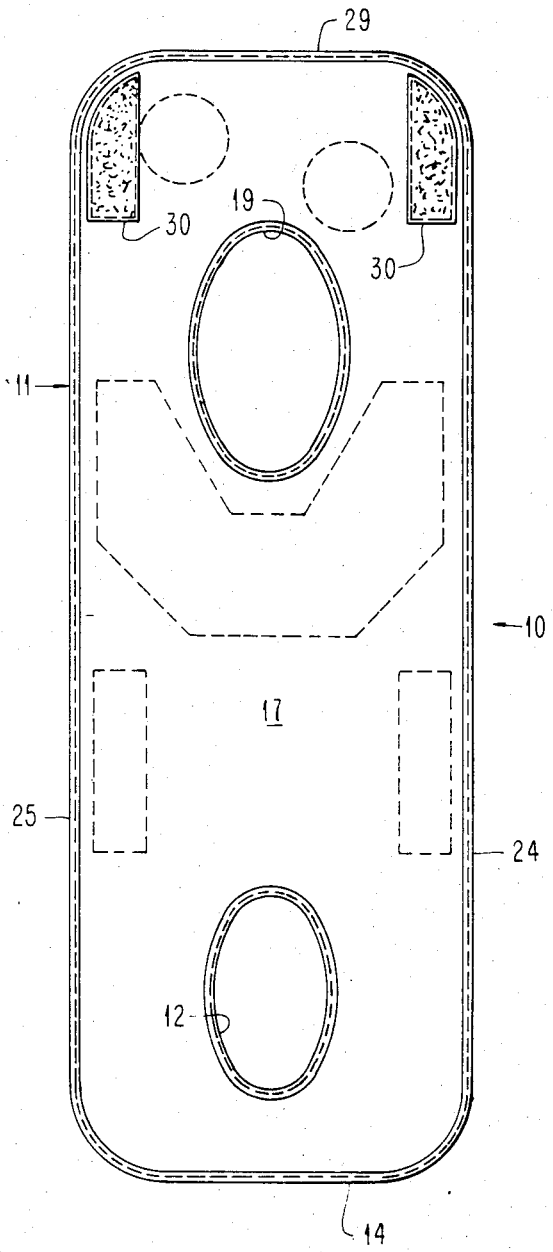
FIG. 2 is a plan view of the inner side of the security hand band of FIG. 1.

Referring to the drawings and particularly FIGS. 1 and 2, there is shown a security hand band 10. The security hand band 10 is formed of a strip 11 of a flexible or pliable material such as cloth, for example, with the cloth being preferably bright colored and water proof.

The strip 11 has a first opening 12, which is preferably oval shaped, adjacent its end 14. The first opening 12 receives a thumb 15 (see FIG. 3) of a user's hand 16. When the user is right handed, the thumb 15 is the right thumb. When the user is left handed, the thumb 15 is the left thumb.

Figure 3:
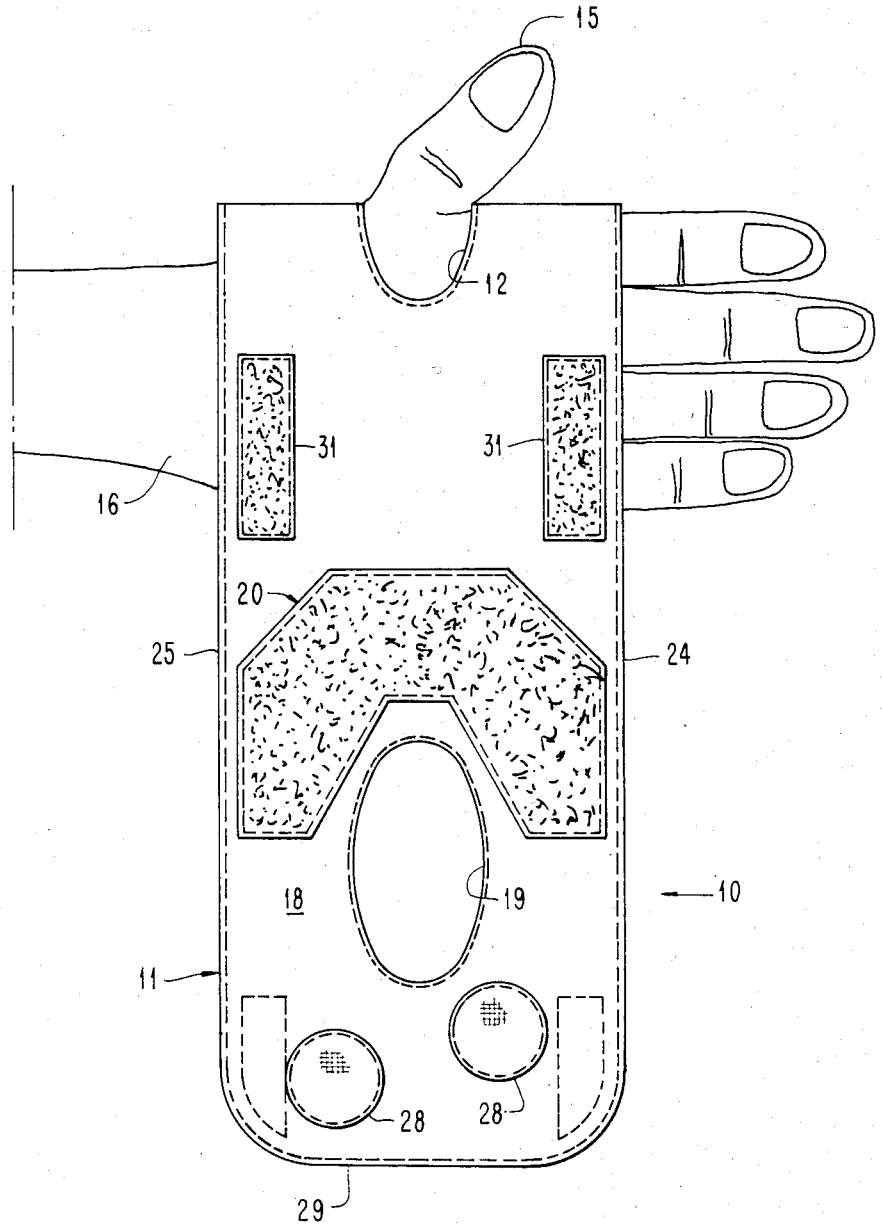
FIG. 3 is a perspective view showing the security hand band initially supported on a thumb of a user prior to being wrapped around the user's hand.

After the thumb 15 is inserted through the first opening 12 in the strip 11, the strip 11 extends over the fist knuckles of the user as shown in FIG. 3. In this position, the strip 11 has an inner side 17 (see FIG. 2) engaging or overlying the user's fist knuckles while an outer side 18 (see FIG. 1) of the strip 11 is viewable.

With the strip 11 positioned as shown in FIG. 3, the strip 11 is wrapped around the palm of the user's hand 16 so that the strip 11 is tight against the back of the user's hand 16. A second opening 19, which is preferably oval shaped, is located in the strip 11 to also have the thumb 15 inserted therethrough after the strip 11 has passed over the palm of the user's hand 16.

Figure 4:
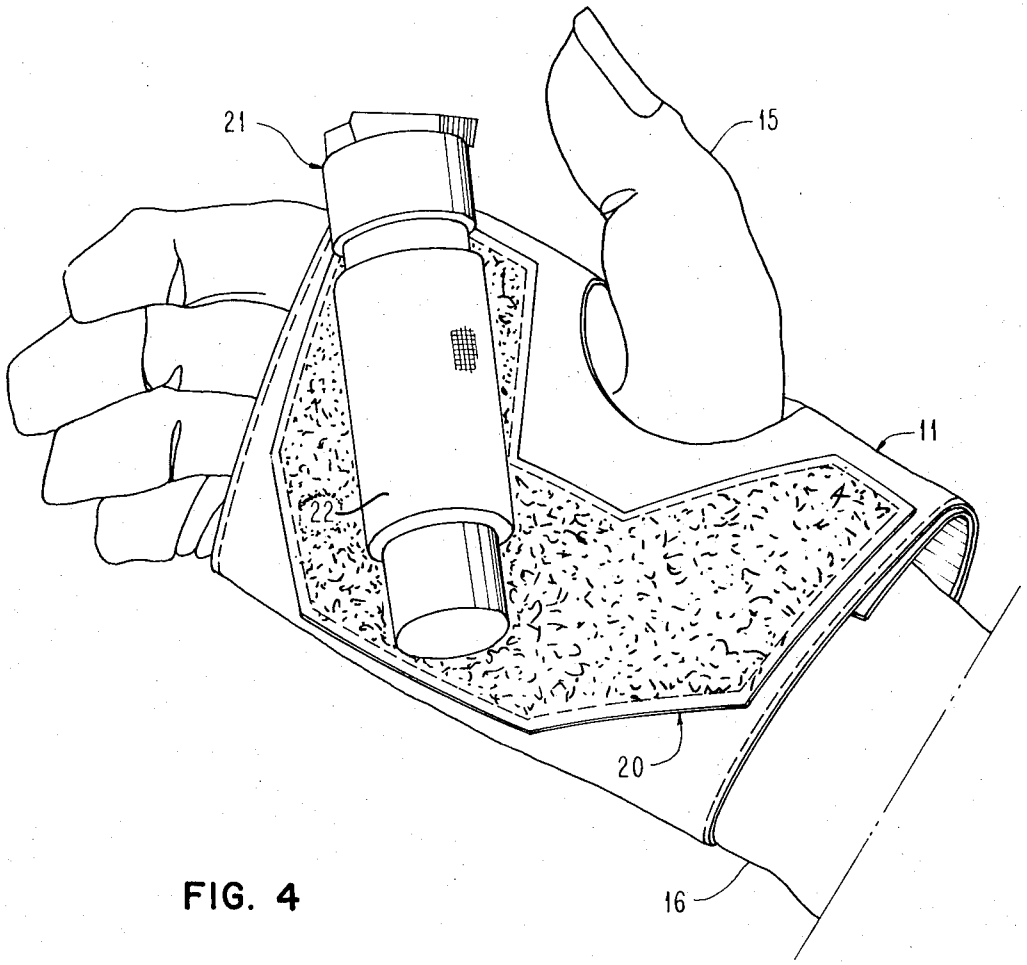
FIG. 4 is a perspective view showing the security hand band on the hand of a user and retaining a protective device thereon.

The outer side 18 (see FIG. 1) of the strip 11 has retaining means 20 to retain a protective article or device such as a tear gas cannister 21 (see FIG. 4), for example. One suitable example of the tear gas cannister 21 is sold by Personal Defense Products, Inc., St. Louis, Mo. as its pocket unit model W 207. It should be understood that any other suitable protective device may be utilized as long as it provides personal protection to the user.

The tear gas cannister 21 has retaining means 22 mounted thereon for cooperation with the retaining means 20 on the outer side 18 of the strip 11. One suitable example of each of the retaining means 20 and the retaining means 22 is a Velcro strip.

The Velcro strip, which forms the retaining means 20, is sewed to the strip 11. The retaining means 20 includes a central portion 23 (see FIG. 1), which is disposed between substantially parallel, longitudinal edges 24 and 25 of the strip 11. The retaining means 20 includes a first portion 26 extending from the central portion 23 between the second opening 19 and the longitudinal edge 24 and towards the longitudinal edge 24. The tear gas cannister 21 is positioned so that the retaining means 22, which is the Velcro strip glued to the tear gas cannister 21, is positioned primarily on the first portion 26 of the retaining means 20 when the user is right handed.

The retaining means 20 includes a second portion 27 extending fom the central portion 23 between the second opening 19 in the strip 11 and the longitudinal edge 25 and towards the longitudinal edge 25 of the strip 11. The retaining means 22 on the tear gas cannister 21 cooperates primarily with the second portion 27 of the retaining means 20 when the user is left handed.

The outer side 18 of the strip 11 has a pair of reflecting elements 28 thereon between the second opening 19 and an end 29 of the strip 11. The reflecting elements 28 are on the back of the user's hand 16 (see FIG. 3) when the strip 11 is in its retained position. The reflecting elements 28 reflect light to provide protection at night to the user.

After the user's thumb 15 is inserted in the second opening 19, the strip 11 is pulled tightly across the palm of the user's hand 16. The strip 11 is retained in position by a pair of attaching elements 30 (see FIG. 2) on the inner side 17 of the strip 11 cooperating with a pair of attaching elements 31 (see FIG. 1) on the outer side 18 of the strip 11 adjacent the longitudinal edges 24 and 25. The attaching elements 30 (see FIG. 2) are adjacent the end 29 of the strip 11 and the longitudinal edges 24 and 25 of the strip 11.

Each of the attaching elements 30 and 31 (see FIG. 1) is preferably a Velcro strip and is sewed to the strip 11. Each of the attaching elements 30 (see FIG. 2) and 31 (see FIG. 1) extends for a sufficient length so as to have an adjustable area for attachment in accordance with the size of the user's hand 16 (see FIG. 3). Thus, while each of the attaching elements 30 (see FIG. 2) and 31 (see FIG. 1) is substantially the same length and the same width, the fitting of the strip 11 on the user's hand 16 (see FIG. 3) normally results in only portions of each of the attaching elements 30 (see FIG. 2) engaging only portions of each of the attaching elements 31 (see FIG. 1).

As one example, the strip 11 could have a length of fifteen inches and a width of five inches. The first opening 12 would be formed one inch from the end 14 of the strip 11 and extend for about two and one-half inches. The first opening 12 would have a maximum width of about one and one-half inches. The second opening 19 would start about two and one-half inches from the end 29 and extend about three and one-half inches towards the first opening 12. The maximum width of the second opening 19 would be about two inches.

While the present invention has shown and described the strip 11 as being formed of cloth, any other suitable flexible or pliable material may be employed. While the protective device has been identified as the tear gas cannister 21, it should be understood that any other suitable protective device may be employed. While the retaining means 20 and 22 (see FIG. 4) and the attaching elements 30 (see FIG. 2) and 31 (see FIG. 1) have been shown and described as being Velcro strips, it should be understood that any other suitable retaining means or attaching elements may be employed if desired.

An advantage of this invention is that it provides protection to a walker, a jogger, a runner, or an elderly person. Another advantage of this invention is that a protective device is always available for utilization. A further advantage of this invention is that it can be used by either a right handed or left handed person. Still another advantage of this invention is that it will fit various size hands. A still further advantage of this invention is that it serves as a deterrent to dissuade a potential attacker from causing harm to a user.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A security hand band including:

a strip of flexible material for wrapping around either hand of a user in a non-binding relation;

said strip of flexible material having a first opening adjacent one end thereof to initially receive a thumb of the user;

said strip of flexible material having retaining means on its outer side intermediate its ends to retain a protective device or the like adjacent the palm of the hand of the user irrespective of the position of the hand of the user and without any gripping of the protective device by the user to form the sole retention of the protective device on said strip of flexible material, said retaining means being disposed on said strip of flexible material for positioning in the palm of the hand of the user after said first opening has received the thumb of the user and said strip of flexible material has a portion passed around the back of the hand of the user prior to said strip of flexible material being passed over the palm of the hand of the user;

said strip of flexible material having a second opening to receive the thumb of the user after said strip of flexible material has passed over the palm of the hand of the user, said strip of flexible material having said second opening disposed closer to its other end than to its one end;

said strip of flexible material having attaching means to attach its portion beyond said second opening to the portion of said strip of flexible material passed around the back of the hand of the user prior to said strip of flexible material being passed over the palm of the hand of the user;

said strip of material including a pair of substantially parallel, longitudinal edges;

and said attaching means including:

first means disposed adjacent the other end of said strip of flexible material on its inner side adjacent each of said longitudinal edges of said strip of material;

and second means disposed on the outer side of said strip of flexible material between said first opening and said retaining means adjacent each of said longitudinal edges of said strip of material.

2. The security hand band according to claim 1 including reflecting means disposed between said second opening and the other end of said strip of flexible material, said reflecting means being disposed on the outer side of said strip of flexible material.

3. The security hand band according to claim 2 in which each of said first means of said attaching means and said second means of said attaching means is a selected length to enable adjustment of the area of attachment in accordance with the size of the hand of the user.

4. The security hand band according to claim 3 in which said strip of flexible material is cloth.

5. A security hand band including:

a strip of flexible material for wrapping around a hand of a user;

said strip of flexible material having a first opening adjacent one end thereof to initially receive a thumb of the user;

said strip of flexible material having retaining means on its outer side intermediate its ends to retain a protective device or the like adjacent the palm of the hand of the user, said retaining means being disposed on said strip of flexible material for positioning in the palm of the hand of the user after said first opening has received the thumb of the user and said strip of flexible material has a portion passed around the back of the hand of the user prior to said strip of flexible material being passed over the palm of the hand of the user;

said strip of flexible material having a second opening to receive the thumb of the user after said strip of flexible material has passed over the palm of the hand of the user, said strip of flexible material having said second opening diposed closer to its other end than to its one end;

said strip of flexible material having attaching means to attach its portion beyond said second opening to the portion of said strip of flexible material passed around the back of the hand of the user prior to said strip of flexible material being passed over the palm of the hand of the user;

said attaching means including:

first means disposed adjacent the other end of said strip of flexible material on its inner side;

and second means disposed on the outer side of said strip of flexible material between said first opening and said retaining means;

said strip of material including a pair of substantially parallel, longitudinal edges;

and said retaining means including:

a central portion disposed between said longitudinal edges of said strip of flexible material;

a first extending portion extending from said central portion between said second opening and one of said longitudinal edges of said strip of flexible material;

a second extending portion extending from said central portion between said second opening and the other of said longitudinal edges of said strip of flexible material;

and each of said central portion, said first extending portion, and said second extending portion including means for cooperation with the protective device to retain the protective device thereagainst adjacent the palm of the hand of the user.

6. The security hand band according to claim 5 including reflecting means disposed between said second opening and the other end of said strip of flexible material, said reflecting means being disposed on the outer side of said strip of flexible material.

7. The security hand band according to claim 6 in which each of said first means of said attaching means and said second means of said attaching means is a selected length to enable adjustment of the area of attachment therebetween in accordance with the size of the hand of the user.

8. The security hand band according to claim 7 in which said strip of flexible material is cloth.

9. A security hand band including:

a strip of flexible material for wrapping around a hand of a user;

said strip of flexible material having a first opening adjacent one end thereof to initially receive a thumb of the user;

said strip of flexible material having retaining means on its outer side intermediate its ends to retain a protective device or the like adjacent the palm of the hand of the user, said retaining means being disposed on said strip of flexible material for positioning in the palm of the hand of the user after said first opening has received the thumb of the user and said strip of flexible material has a portion passed around the back of the hand of the user prior to said strip of flexible material being passed over the palm of the hand of the user;

said strip of flexible material having a second opening to receive the thumb of the user after said strip of flexible material has passed over the palm of the hand of the user, said strip of flexible material having said second opening disposed closer to its other end than to its one end;

said strip of flexible material having attaching means to attach its portion beyond said second opening to the portion of said strip of flexible material passed around the back of the hand of the user prior to said strip of flexible material being passed over the palm of the hand of the user;

said strip of material including a pair of substantially parallel, longitudinal edges;

and said retaining means including:

a central portion disposed between said longitudinal edges of said strip of flexible material;

a first extending portion extending from said central portion between said second opening and one of said longitudinal edges of said strip of flexible material;

a second extending portion extending from said central portion between said second opening and the other of said longitudinal edges of said strip of flexible material;

and each of said central portion, said first extending portion, and said second extending portion including means for cooperation with the protective device to retain the protective device thereagainst adjacent the palm of the hand of the user.

10. The security hand band according to claim 9 including reflecting means disposed between said second opening and the other end of said strip of flexible material, said reflecting means being disposed on the outer side of said strip of flexible material.

11. The security hand band according to clim 10 in which said attaching means has its area of attachment adjustable in accordance with the size of the hand of the user.

12. The security hand band according to claim 11 in which said strip of flexible material is cloth.

* * * * *